US008197192B2

(12) United States Patent
Andersson

(10) Patent No.: US 8,197,192 B2
(45) Date of Patent: Jun. 12, 2012

(54) PUMP FOR PUMPING CONTAMINATED LIQUID INCLUDING SOLID MATTER

(75) Inventor: Patrik Andersson, Skogas (SE)

(73) Assignee: Xylem IP Holdings LLC, White Plains, NY (US)

( * ) Notice: Subject to any disclaimer, the term of this patent is extended or adjusted under 35 U.S.C. 154(b) by 963 days.

(21) Appl. No.: 12/161,875

(22) PCT Filed: Jan. 18, 2007

(86) PCT No.: PCT/SE2007/000044

§ 371 (c)(1),
(2), (4) Date: Jul. 23, 2008

(87) PCT Pub. No.: WO2007/084056

PCT Pub. Date: Jul. 26, 2007

(65) Prior Publication Data

US 2009/0022582 A1 Jan. 22, 2009

(30) Foreign Application Priority Data

Jan. 23, 2006 (SE) ..... 0600135

(51) Int. Cl.
*F04D 29/08* (2006.01)

(52) U.S. Cl. ..... 415/121.1; 415/97; 415/34; 415/131

(58) Field of Classification Search ..... 415/97, 415/34, 131, 121.1
See application file for complete search history.

(56) References Cited

U.S. PATENT DOCUMENTS

| | | | | |
|---|---|---|---|---|
| 2,865,299 | A | 12/1958 | Hornschuch et al. | |
| 4,417,849 | A * | 11/1983 | Morris | 415/131 |
| 5,722,812 | A * | 3/1998 | Knox et al. | 415/199.1 |
| 2001/0031202 | A1 * | 10/2001 | Nowack | 415/206 |

FOREIGN PATENT DOCUMENTS

EP 1247990 A1 10/2002

* cited by examiner

*Primary Examiner* — Victor A Mandala
*Assistant Examiner* — Krista Soderholm
(74) *Attorney, Agent, or Firm* — Browdy and Neimark, PLLC

(57) ABSTRACT

The invention relates to a pump for pumping contaminated liquid including solid matter, comprising an impeller (1), which is rotatable in a pump chamber of said pump, the impeller (1) being movable in the axial direction in relation to a seal housing cover (3) between a first position adjacent to an impeller seat (2) and a second position spaced apart from said impeller seat (2), said pump also comprising a cavity (17) defined by the seal housing cover (3) and the impeller (1), and at least one opening gap (20) connecting said cavity and said pump chamber. Furthermore, said opening gap (20) has a first flow area when the impeller (1) is in the first position, and a second flow area bigger than said first flow area when the impeller (1) is' spaced apart from said first position.

13 Claims, 4 Drawing Sheets

PUMP FOR PUMPING CONTAMINATED LIQUID INCLUDING SOLID MATTER

TECHNICAL FIELD OF THE INVENTION

The present invention relates generally to the field of pumps for sewage or waste water, and more specifically to a pump for pumping unscreened contaminated liquid including solid matter, such as plastic materials, hygiene articles, textile, rags, etc. Said pump comprises an impeller, which is rotatable in a pump chamber of said pump, the impeller being movable in the axial direction in relation to a seal housing cover between a first position adjacent to an impeller seat and a second position spaced apart from said impeller seat, said pump also comprising a cavity defined by the seal housing cover and the impeller, and at least one opening gap connecting said cavity and said pump chamber.

BACKGROUND OF THE INVENTION

In sewage stations, septic tanks, wells, etc., it often occur that solid matter or pollutants, such as socks, sanitary pads, paper, etc., clogs the submersible pump that is lowered into the basin of the system. The contaminations are sometimes too big to pass through the pump if the impeller and the impeller seat are located at a fixed distance from each other. A way of solving the problem of solid matter clogging the pump is to admit the impeller to be movable in the axial direction in relation to the seal housing cover and the impeller seat, in order to form a momentarily bigger passage through the pump.

Usually the impeller is connected to a drive shaft extending from an engine located in a sealed off compartment of the pump. Thus, a seal is arranged between the drive shaft and the seal housing cover preventing liquid from entering the sealed off engine compartment. Adjacent to said seal is a cavity defined by the seal housing cover and the top surface of the impeller, which cavity communicates with the pump chamber of the pump via an opening gap. It is crucial that the opening gap is as small as possible, because if solid matter enters into the cavity it may damage the seal. However, at the same time the liquid shall be able to flow into and out from the cavity in order to cool down and lubricate said seal.

A decisive problem arises in the case when the impeller is movable in relation to the seal housing cover, and accordingly the volume of the cavity defined by the seal housing cover and the impeller is changed, i.e. decreased or increased. At the same time said cavity has to be bigger than for pumps having a stationary impeller, to allow a proper movement of the impeller. Most of the fluid contained in the cavity at the time the impeller starts to move upwards shall be pressed out through the small opening gap, and this takes place during seconds or parts of seconds. Thereby a great pressure peak arises in the cavity and the risk of damaging the seal is increased.

If said seal is damaged the engine and the entire pump may be damaged, and such an unintentional shutdown is costly, due to expensive, cumbersome and unplanned maintenance work.

A closely related Swedish Patent Application, SE 0501542-5, directed to the applicant, shows a pump for pumping contaminated liquid including solid matter. The pump comprises a rotatable impeller, which is movable in the axial direction in relation to the seal housing cover, or pump housing, between a first position and a second position. However, the above mentioned patent application does not discuss the abovementioned problems.

Furthermore, submergible pumps are used to pump fluid from basins that are hard to get access to for maintenance and the pumps often operate for long periods of time, not infrequently up to 12 hours a day or more. Therefore it is highly desirable to provide a pump having long durability.

SUMMARY OF THE INVENTION

The present invention aims at obviating the aforementioned disadvantages of previously known pumps, and at providing an improved pump. An object of the present invention is to provide a pump of the initially defined type, in which the pressure against the seal located between the seal housing cover and the drive shaft is adapted in order not to damage said seal during operation. It is another object of the present invention to provide a pump, in which the inertial force against axial movement of the impeller is reduced. It is yet another object of the present invention to provide a pump having an improved durability, especially concerning the durability of the seal.

According to the invention at least the primary object is attained by means of the initially defined pump having the features defined in the independent claim. Preferred embodiments of the present invention are further defined in the dependent claims.

According to the present invention, there is provided a pump of the initially defined type, which is characterized in that said opening gap has a first flow area when the impeller is in the first position, and a second flow area bigger than said first flow area when the impeller is spaced apart from said first position.

Thus, the present invention is based on the insight of the importance that a movability of the impeller in the axial direction in relation to the seal housing cover results in a partial evacuation and refilling of the cavity above the impeller as a result of the axial movement of the impeller, which has to be done very rapidly at the same time as solid matter shall not pass into the cavity during operation. More precisely, the opening gap has to be small when the impeller is in the first position and big when the impeller is spaced apart from the first position.

In a preferred embodiment of the present invention, the opening gap is annular and defined by the seal housing cover and the circumference of the impeller. This means that the shape and function of the opening gap are independent of the rotational speed of the impeller.

According to a preferred embodiment, the impeller may be moved a great distance from the impeller seat in the axial direction, preferably as much as the diameter of the open channel of the impeller seat. Then the ability to pass solid matter through the pump is considerably increased.

BRIEF DESCRIPTION OF THE DRAWINGS

A more complete understanding of the above mentioned and other features and advantages of the present invention will be apparent from the following detailed description of preferred embodiments in conjunction with the appended drawings, wherein.

DETAILED DESCRIPTION OF PREFERRED EMBODIMENTS OF THE INVENTION

Figure 1:
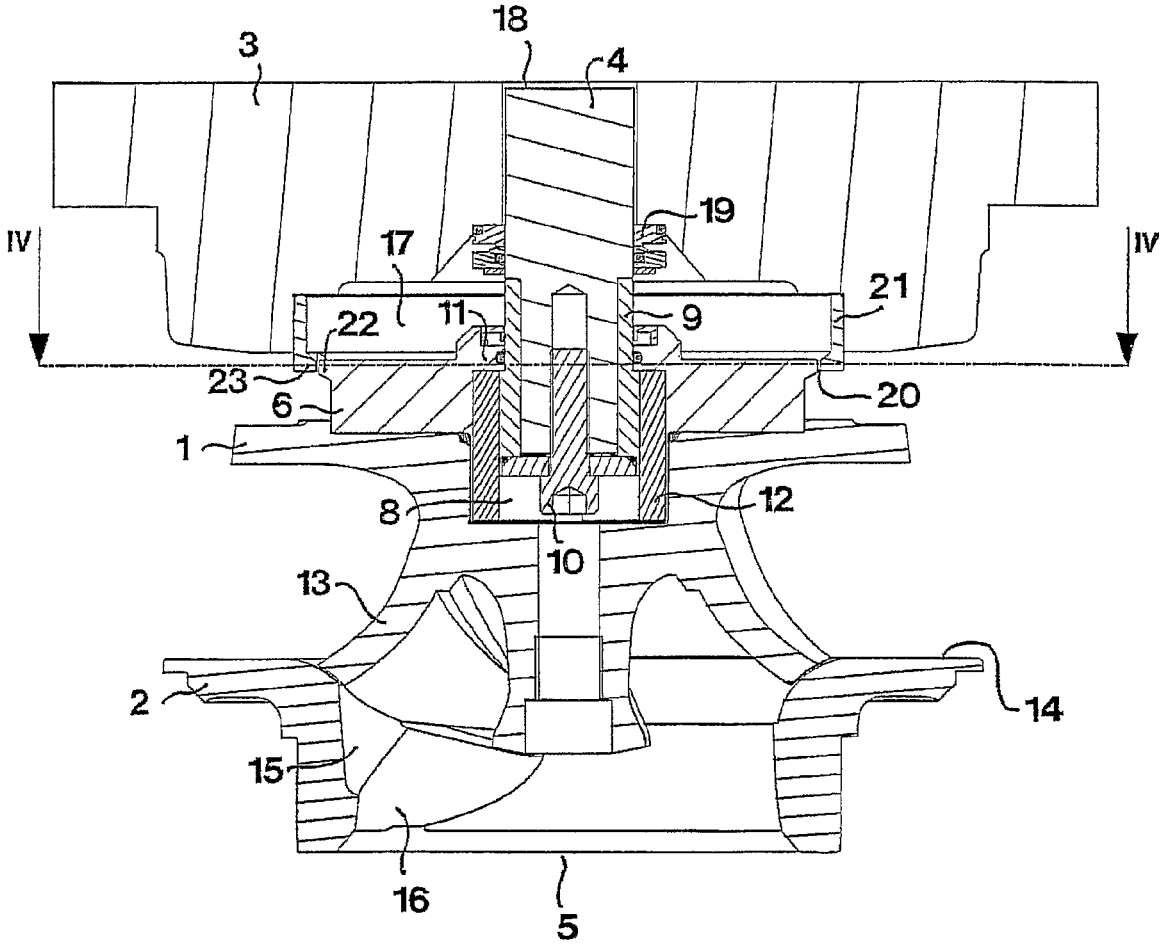
FIG. 1 is a cross sectional view of the impeller, the impeller seat and a seal housing cover, the impeller being in a first, lower position.
Figure 2:
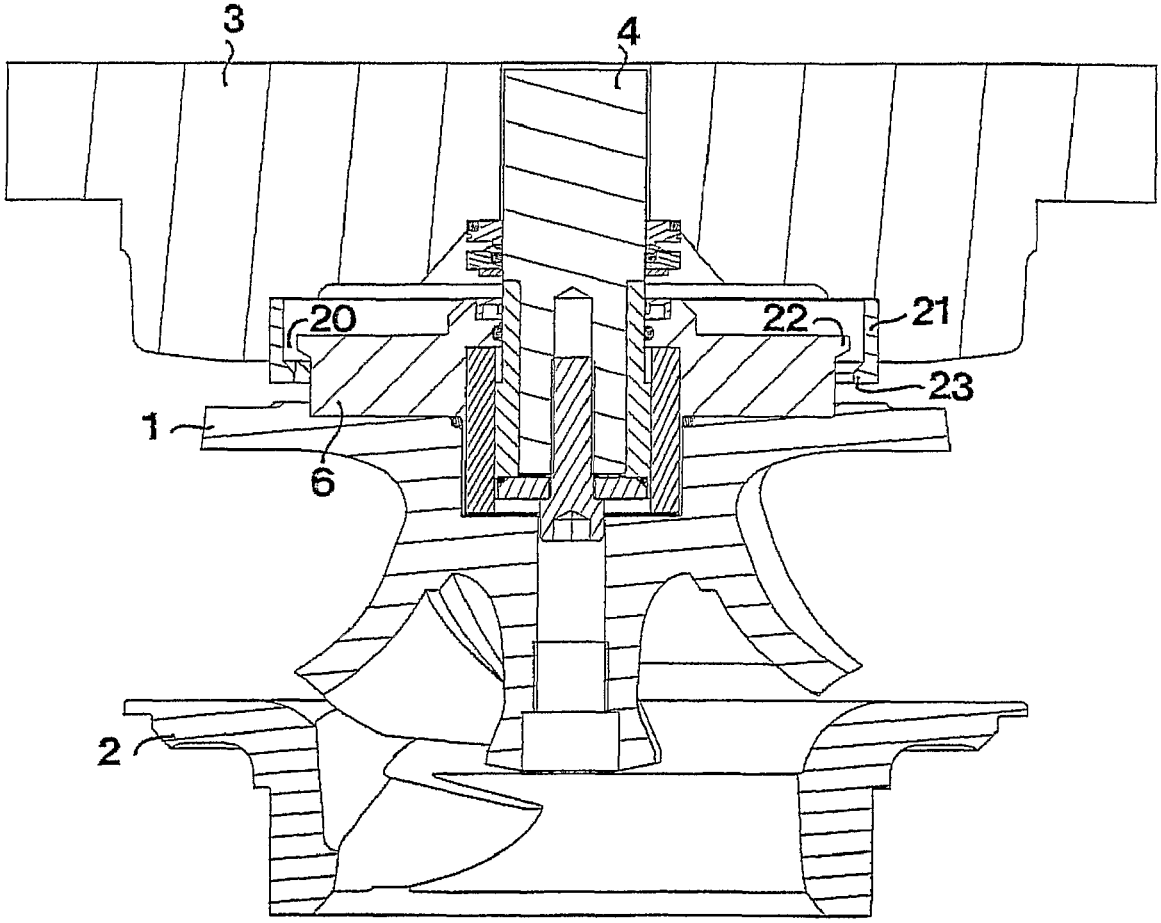
FIG. 2 is a cross sectional view corresponding to FIG. 1, the impeller being in an intermediate position spaced apart from said first position.
Figure 3:
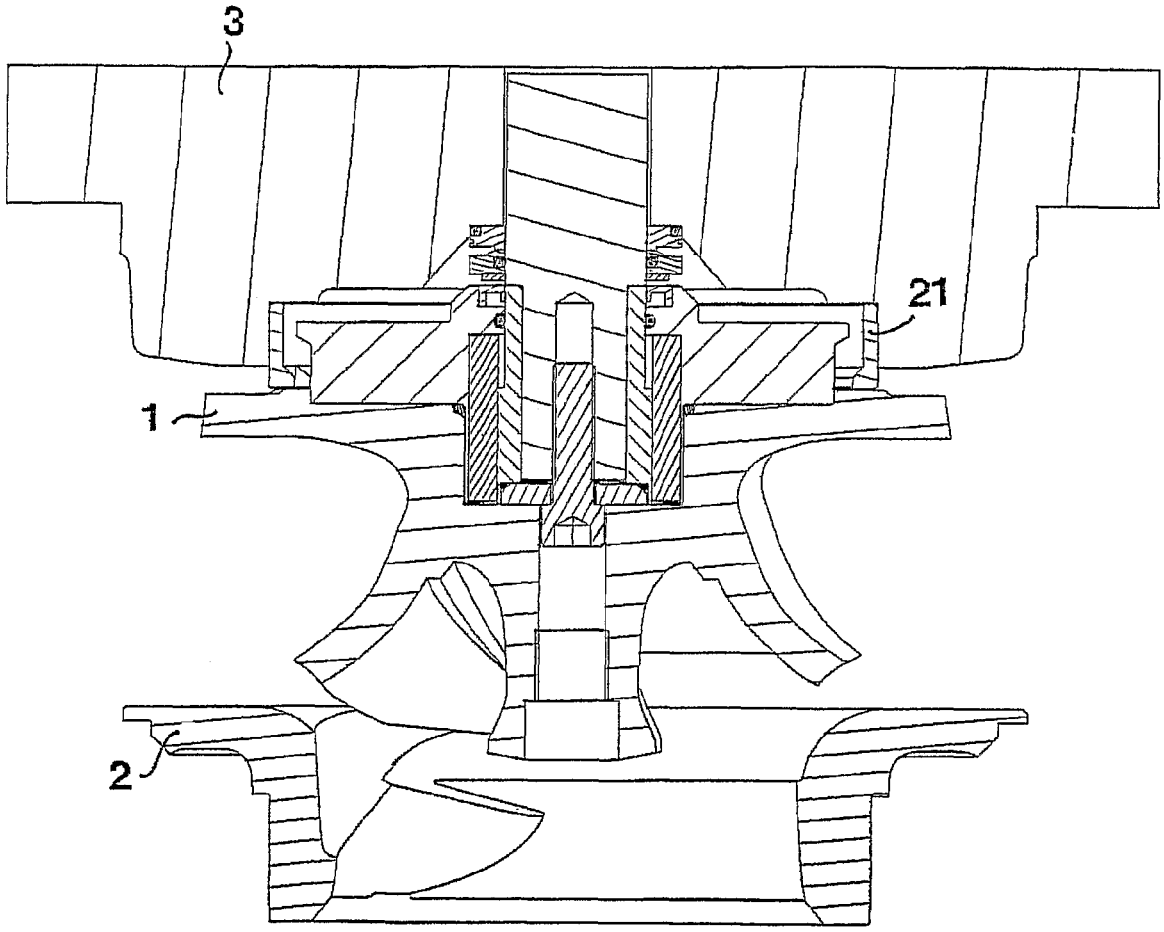
FIG. 3 is a cross sectional view corresponding to FIG. 1, the impeller being in a second, upper position.

FIGS. 1-3 shows an impeller 1, an impeller seat 2 accommodated in a pump housing of a pump, and a seal housing cover 3. The other parts of the pump/pump housing are removed for the sake of simplicity of reading the figures. The invention relates to pumps in general, but in the preferred embodiment the pump is constituted by a submergible centrifugal pump.

In a preferred embodiment of the present invention the impeller seat 2 is constituted by an insert releasably connected to the pump housing by being located in a seat (not shown) in the pump housing in such a way that the insert cannot rotate relative to the pump housing. The impeller 1 is suspended in a drive shaft 4 extending from above, and is rotatably journalled in the pump. More precisely, the impeller 1 is rotatable in a pump chamber of the pump. An upper end (not shown) of the drive shaft 4 is connected to an engine (not shown) of the pump. In this connection it shall be pointed out that the drive shaft 4 is cut off in the drawings. In the shown embodiment a lower end of the drive shaft 4 is connected to the impeller 1 by means of a joint in such a way that the impeller 1 is movable in the axial direction along the drive shaft 4, but rotates jointly with the drive shaft 4.

The axial movability the impeller 1 in relation to the seal housing cover 3 should be of any appropriate length depending on the application, i.e. from 0 mm and upwards. Preferably said movability should be at least 15 mm, more preferably at least 40 mm, and most preferably at least as much as the diameter of an open channel 5 of the impeller seat 2. In the shown embodiment the diameter of the open channel 5 is approximately 150 mm. Furthermore, the axial movability may be achieved in a lot of ways, but in the preferred embodiment of the present invention the impeller 1 is movable along the axial direction of the drive shaft 4.

The above mentioned joint of the pump admits axial movability of the impeller 1 in relation to the drive shaft 4, at the same time as the drive shaft 4 inevitably transmits a rotating motion to the impeller 1. In the shown embodiment the joint comprises a connection part 6 of the impeller 1, provided in a central part of the impeller 1 and connected to the impeller 1 by means of bolts 7, or the like (see FIG. 4). Alternatively the connection part 6 may be integrated with the impeller 1. The connection part 6 presents a hole 8 in a central part thereof, which hole 8 accommodate the lower end of the drive shaft 4. In the preferred embodiment of the pre-sent invention the drive shaft 4 is provided with a sleeve 9 at the lower end thereof, the sleeve 9 being connected to the drive shaft 4 by means of a bolt 10, or the like. Alternatively the sleeve 9 may be integrated with the drive shaft 4.

The sleeve 9 has a first, upper part having a first external diameter, which is essentially equal to the internal diameter of a flange 11 of the connection part 6. Furthermore, the sleeve 9 has a second, lower part having a diameter larger than said first diameter of the sleeve 9. The diameter of the second part of the sleeve 9 is essentially equal to the internal diameter of said hole 8. Due to these dimensional relationships the impeller 1 is suspended in the drive shaft 4, when the second part of the sleeve 9 rests against the flange 11 of the connection part 6. The hole 8 presents a larger extension in the axial direction than the second part of the sleeve 9, the connection part 6 and thus the impeller 1 being movable an axial distance essentially equal to that difference.

In the preferred embodiment of the invention said joint comprises at least one discrete element 12 arranged at the interface between the connection part 6 (or the impeller 1) and the sleeve 9 (or the drive shaft 4). The element 12 imperatively transmits a rotating motion from the drive shaft 4 to the impeller 1 as well as allows the impeller 1 to move in the axial direction in relation to the drive shaft 4 and the seal housing cover 3, or pump housing. The connection part 6 is provided with at least one recess (not shown) for each element 12, the recess extends in the axial direction of the drive shaft 4. In the sleeve 9, opposite to the recess of the connection part 6, is formed an interacting recess (not shown), which together with the recess of the connection part 6 accommodate said element 12. Preferably multiple elements 12 are used, which are equidistant separated along the circumference of the drive shaft 4, and the dimensions of the elements 12 are determined by the torque being transmitted from the drive shaft 4 to the impeller 1. In the shown embodiment in FIGS. 1-3 the discrete element 12 is constituted by a bar, preferably a circular bar, due to a manufacturing point of view.

It shall be pointed out that in an alternative embodiment the discrete element 12 can be constituted by a number of balls following the recess of the sleeve 9 as the impeller 1 moves in the axial direction. More precisely, the recess of the sleeve 9 may in this case be constituted by several semi spherical recesses, one for each ball. Alternatively, the discrete element 12 may be integrated with the inner surface of the sleeve 9, i.e. ridges on the inner surface extending into the recesses of the connection part 6, or vice versa, such as a spline joint.

The impeller 1, in a preferred embodiment of the present invention, is freely movable along the drive shaft 4, i.e. no springs or the like affects or obstructs the movement. During operation the pressure downstreams of the impeller is higher than the pressure upstreams of the impeller, and thereby said impeller is urged towards the impeller seat. Any force from a solid matter on the impeller 1 from underneath that overcomes the higher pressure on the top side of the impeller 1 will manage to raise the impeller 1 from the impeller seat 2. When the solid matter is removed the impeller 1 automatically returns to the position according to FIG. 1 since the pressure on the top side of the impeller 1 is higher than the pressure on the bottom side of the impeller 1.

The impeller 1 comprises at least one vane 13 extending from the centre of the impeller 1 towards the periphery thereof, preferably in a spiral shape. In the shown embodiment the impeller 1 has two vanes 13, but it shall be pointed out that the number of vanes 13 and their extension may vary greatly, in order to suit different liquids and applications.

In a top surface 14 of the impeller seat 2 and contiguous to the open channel 5 thereof, is provided at least one groove or relief groove 15. The groove 15 extends from the open channel 5 of the impeller seat 2 towards the periphery thereof. Preferably in a spiral shape that sweeps outwards in the direction of rotation of the impeller 1. The number of grooves 15 and their shape and orientation may vary greatly, in order to suit different liquids and applications. The function of the groove 15 is to guide the solid matter from the open channel 5 below the impeller 1 outwards to the periphery of the pump chamber. As solid matter passes through the pump, some will fasten underneath the vanes 13 of the impeller 1 and slow down the rotating motion of the impeller 1, and in severe cases even stop the same. But the groove 15 contribute to keep the vanes 13 clean, by scraping of the solid matter each time the vane 13 passes the same. If the solid matter is to big to fit in the groove 15, between the impeller 1 and the impeller seat 2, the impeller 1 will be moved upwards away from the impeller seat 2 by the solid matter and thereby admitting the solid matter to pass through the pump (as is shown in FIGS. 2-3).

In order to ensure that the open channel 5 does not get clogged, the impeller seat 2 is preferably provided with means for guiding the solid matter towards the groove 15. The guiding means comprises at least one guide pin 16 extending from the open channel 5 of the impeller seat 2. The guide pin 16 extends generally in the radial direction of the impeller seat 2 and is located below the impeller 1. Preferably the guide pin 16 terminates adjacent to the "inlet" of said groove 15. It shall be pointed out that the most preferred number of grooves 15 is one. Furthermore, the pump shall preferably comprise one guide pin 16. Otherwise the open channel 5 should be too obstructed, which would adversely affect the function of the pump.

A cavity 17 defined by the seal housing cover 3 and the top surface of the impeller 1, or by the top surface of the connection part 6 as in the shown embodiment. Said cavity 17 may be described as an inverted cup shaped recess in the seal housing cover 3, and the drive shaft 4 projects from a hole 18 connecting the cavity 17 and the engine compartment of the pump. Said hole 18 is preferably concentric to the cup shaped recess/cavity 17. A mechanical seal 19 is provided around the drive shaft 4 at the orifice of the hole 18, in order to prevent liquid from entering the engine compartment. In the shown embodiment the mechanical seal 19 is made up of several cooperating members. More precisely, a first member is fixed to the seal housing cover 3 and a second member is fixed to the rotating drive shaft 4, the two members presenting opposite metal surfaces located really close to each other without touching, a sealing fluid film being established between the two surfaces. Said seal 19 is cooled down and lubricated by the pumped liquid, which during operation of the pump flows into and out of the cavity through an opening gap 20. More precisely, said opening gap 20 connects the pump chamber and the cavity 17 and permits flow communication in both directions. Preferably, the opening gap 20 is defined by the seal housing cover 3 and the circumference of the impeller 1, or the connection part 6, in such a way that a generally annular opening gap 20 is established (see FIG. 4). A ring shaped member 21 may be inserted in the cup shaped recess 17 of the seal housing cover 3, a lower rim of which member 21 preferably protrudes below the seal housing cover 3. In an alternative embodiment said member 21 may be integrated with the seal housing cover 3. It shall be pointed out that the cavity 17, preferably presents a generally complementary shape compared to the connection part 6 of the impeller 1.

In FIG. 1 the impeller 1 is in a first lower position, according to ordinary operation of the pump, i.e. when liquid and solid matter is pumped without the impeller 1 being moved in the axial direction in relation to the seal housing cover 3. In this position the opening gap has a first flow area and is big enough to let liquid through but at the same time small enough to prevent solid matter from entering into the cavity 17. If solid matter should enter the cavity 17, the seal 19 runs the risk of getting damaged. In the shown embodiment the opening gap is approximately 1 mm wide. But other suitable dimensions are feasible depending on application and the pumped liquid.

The connection part 6 of the impeller 1 presents a first outer diameter close to the impeller 1, and an outer flange 22 protruding radially outwards at the top surface of the connection part 6. The outer flange 22 presents a second outer diameter which is bigger than said first outer diameter. The rim of the outer flange 22 facing outwards may have any suitable shape, e.g. pointed or squared as in the shown embodiment. Further, the member 21 (or cup shaped recess 17) of the seal housing cover 3 has a first inner diameter at an upper part of the member 21 of the seal housing cover 3, and an inner flange 23 protruding radially inwards at the orifice of said member 21 (or recess 17). The inner flange 23 presents a second inner diameter which is smaller than said first inner diameter as well as bigger than said second outer diameter of the outer flange 22. The rim of the inner flange 23 facing inwards may have any suitable shape, e.g. pointed or squared as in the shown embodiment.

If a large piece of solid matter enters the pump, the impeller 1 is forced to move away from the impeller seat 2 in order to let the large piece trough (see FIGS. 2-3). During this operation, the connection part 6 of the impeller 1 moves upwards into the cavity 17, as a piston into a cylinder. Thereby the rim of the outer flange 22 moves upwards in relation to the rim of the inner flange 23. After a small axial movement of the impeller 1 the rim of the outer flange 22 faces the part of the member 21 having the first inner diameter and the rim of the inner flange 23 faces the part of the connection part 6 having the first outer diameter. Hereby, the width of the opening gap 20 is increased and the opening gap 20 presents a second flow area bigger than above mentioned first flow area, in the shown embodiment the width of the opening gap 20 is approximately 4 mm (see FIG. 2). In other words, when the impeller 1 is spaced apart from the first position adjacent to the impeller seat 2 the opening gap 20 is increased, i.e. the flow area of the opening gap 20 is increased.

Thanks to the increased flow area of the opening gap 20 a bigger liquid flow may pass from the cavity 17 to the pump chamber at a certain time period, or vice versa.

In FIG. 3 the impeller 1 has reached a second upper position, in which the lower rim of the member 21 abuts an upper surface of the impeller 1 surrounding the connection part 6. Just before said abutment takes place the liquid flow through the opening gap 20 is more and more limited and finally totally obstructed, in order to slow down the movement of the impeller 1 before the upper surface of the impeller 1 abuts the rim of the member 21 (or the seal housing cover).

Figure 4:
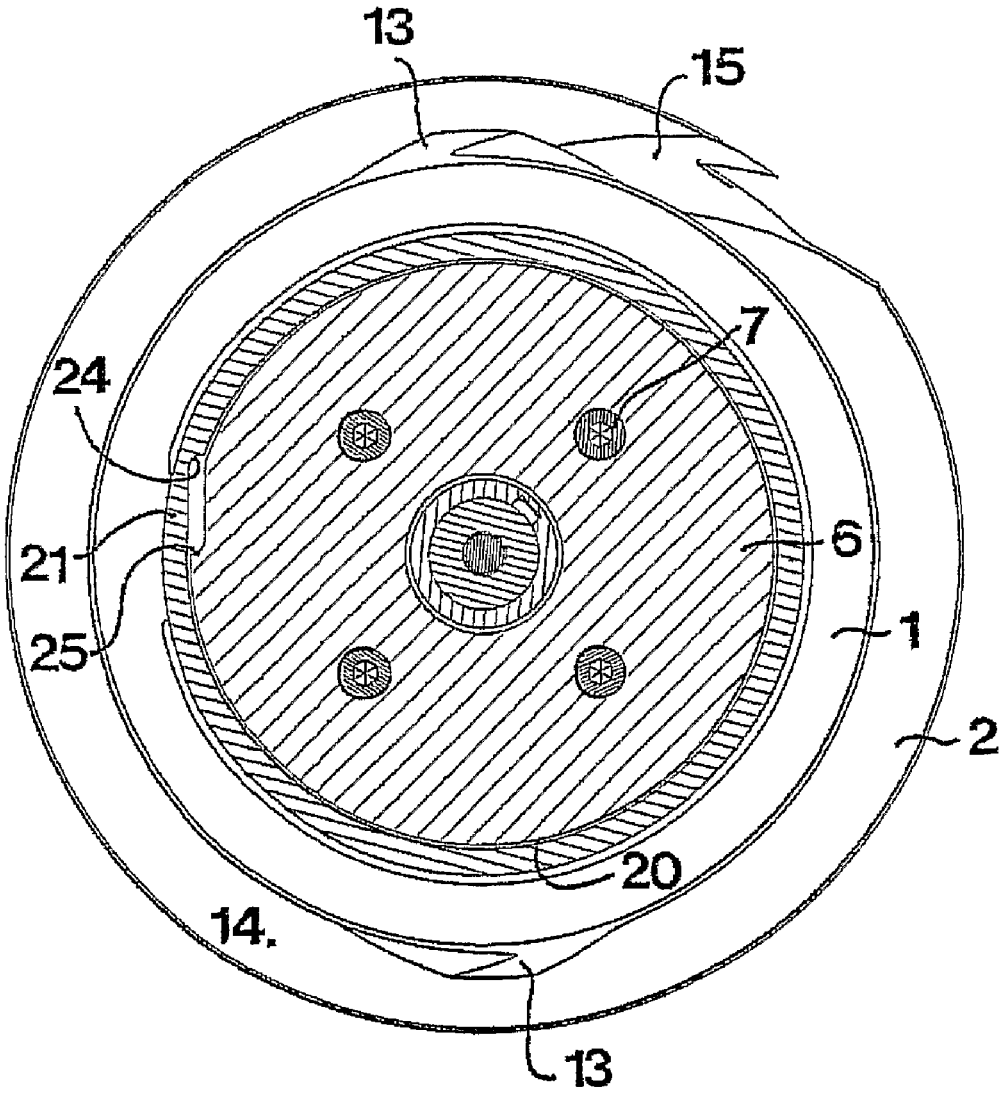
FIG. 4 is a cross sectional view from above taken along the line IV-IV in FIG. 1.

In FIG. 4 is shown a cross sectional view from above taken along the line IV-IV in FIG. 1. In the outer part of the figure is the top surface 14 of the impeller seat 2 shown having the groove 15. Inside of the impeller seat 2 is the upper surface of the impeller 1 and two vanes 13 shown. The outer sectioned ring is the member 21, more precisely the inner flange 23 of the member 21. Inside of the member 23 is the connection part 6 of the impeller 1 shown, which is connected to the impeller 1 by means of screws 7 or the like. The inner flange 23 presents a recess 24 and the outer flange 22 presents a corresponding recess 25, which recesses 24, 25 have the function of removing solid matter that may stick to the inner flange 23 and the outer flange 22. The recess 25 of the outer flange 22 removes solid matter from the inner flange 23 and the recess 24 of the inner flange 23 removes solid matter from the outer flange 22.

Feasible Modifications of the Invention

The invention is not limited only to the embodiments described above and shown in the drawings. Thus, the pump, or more precisely the impeller and the seal housing cover may be modified in all kinds of ways within the scope of the appended claims.

It shall be pointed out that the impeller seat may be integrated with the pump housing, and the impeller and drive shaft may be jointly movable in axial direction in relation to the seal housing cover.

It shall also be pointed out that the outer flange of the connection part and the inner flange of the member of the seal housing cover, not necessarily have to be distinct flanges.

Instead the cavity may taper inwards downwards and the connection part may be cone shaped, in order to get a larger flow area of the opening gap when the impeller is spaced apart from the first lower position.

Furthermore, it shall be pointed out that, the connection part and the impeller, as well as, the ring shaped member and the seal housing cover, are synonyms where applicable in the claims as well as in the description.

It shall be pointed out that the term "flow area" as used in the description as well as in the claims, is defined as the momentary smallest flow area that the opening gap presents between the cavity and the pump chamber, i.e. the bottleneck of the opening gap.

It shall also be pointed out that all information about/concerning the terms upper, lower, etc., should be interpreted/read having the devices in their normal working orientation as they are displayed in the FIGS. 1-3 having the drawings oriented in such a way that the reference signs could be properly read.

The invention claimed is:

1. A pump for pumping contaminated liquid including large pieces of solid matter, comprising an open impeller (1), which is rotatable in a pump chamber of said pump, the impeller (1) being movable in the axial direction in relation to a seal housing cover (3) between a first position adjacent to an impeller seat (2) and a second position spaced apart from said impeller seat (2), said pump also comprising a cavity (17) defined by the seal housing cover (3) and the impeller (1), and at least one radial opening gap (20) connecting said cavity and said pump chamber, wherein said opening gap (20) has a first flow area when the impeller (1), in the normal operation of the pump is in the first position, and a second flow area bigger than said first flow area when the impeller (1) is spaced apart from said first position.

2. A pump according to claim 1, wherein the opening gap (20) is annular and defined by the seal housing cover (3) and the circumference of the impeller (1).

3. A pump according to claim 1, wherein the cavity (17) is defined by a cup shaped recess of the seal housing cover (3) and a generally flat surface of a connection part (6) of the impeller (1), which connection part (6) is movable into said recess.

4. A pump for pumping contaminated liquid including solid matter, comprising an open impeller (1), which is rotatable in a pump chamber of said pump, the impeller (1) being movable in the axial direction in relation to a seal housing cover (3) between a first position adjacent to an impeller seat (2) and a second position spaced apart from said impeller seat (2), said pump also comprising a cavity (17) defined by the seal housing cover (3) and the impeller (1), and at least one radial opening gap (20) connecting said cavity and said pump chamber, wherein said opening gap (20) has a first flow area when the impeller (1), in the normal operation of the pump is in the first position, and a second flow area bigger than said first flow area when the impeller (1) is spaced apart from said first position;

wherein the cavity (17) is defined by a cup shaped recess of the seal housing cover (3) and a generally flat surface of a connection part (6) of the impeller (1), which connection part (6) is movable into said recess; and wherein the connection part (6) of the impeller (1) presents a first outer diameter, an outer flange (22) protruding radially outwards at said surface of the connection part (6) presenting a second outer diameter bigger than said first outer diameter, and wherein the cup shaped recess of the seal housing cover (3) has a first inner diameter, an inner flange (23) protruding radially inwards at the orifice of said recess presenting a second inner diameter smaller than said first inner diameter as well as bigger than said second outer diameter of the connection part (6).

5. A pump according to claim 4, wherein the outer flange (22) of the connection part (6) and the inner flange (23) of the seal housing cover (3) are in flush with each other when the impeller (1) is in the first position.

6. A pump according to claim 1, wherein the impeller (1) is movable at least 15 mm from the impeller seat (2).

7. A pump according to claim 1, wherein the impeller (1) is movable at least 40 mm from the impeller seat (2).

8. A pump according to claim 1, wherein the impeller (1) is suspended in a drive shaft (4) of the pump and movable in the axial direction in relation to said drive shaft (4).

9. A pump according to claim 8, wherein the pump comprises at least one discrete element (12) arranged at an interface between the impeller (1) and the drive shaft (4), which discrete element (12) allows axial mutual movement as well as transmits rotary motion.

10. A pump according to claim 9, wherein the impeller (1) and the drive shaft (4) presents recesses in opposite surfaces at said interface, which recesses jointly accommodate said element (12).

11. A pump according to claim 9, wherein the interface accommodate at least two discrete elements (12), which are equidistant separated from each other along the circumference of the drive shaft (4).

12. A pump according to claim 9, wherein each element (12) is constituted by a bar extending in the longitudinal direction of the drive shaft (4).

13. A pump for pumping contaminated liquid including large pieces of solid matter, comprising an impeller (1) rotatable in a pump chamber, and a fixed impeller seat (2) against which said impeller seats when said impeller (1) is at rest;

a shaft and a seal for said impeller (1), and a seal housing cover (3), the impeller (1) being movable in the axial direction in relation to the seal housing cover (3) between a first position when the impeller (1) is seated against the impeller seat (2) and a second position spaced apart from said impeller seat (2), the impeller (1) having a connection part (6) which is axially movable with the impeller (1), a cavity (17) defined by the seal housing cover (3) within which the connection part (6) moves when the impeller (1) is in the second position, and a radial opening gap (20) between the connection part (6) and the cavity (17), the opening gap (20) connecting said cavity (17) and the pump chamber, wherein the opening gap (20) has a first flow area when the impeller (1) is in the first position, and a second flow area bigger than the first flow area when the impeller (2) is spaced apart from the first position.

* * * * *